United States Patent [19]

Harrison

[11] Patent Number: 4,714,162

[45] Date of Patent: Dec. 22, 1987

[54] FLUORESCENT LIGHT BULB HOLDER

[76] Inventor: Kim A. Harrison, P.O. Box 1224, Desoto, Tex. 75115

[21] Appl. No.: 942,601

[22] Filed: Dec. 17, 1986

[51] Int. Cl.[4] ..... B65D 85/42

[52] U.S. Cl. ..... 206/419; 182/129; 248/210

[58] Field of Search ..... 182/115, 123, 129; 206/573, 418, 419, 443; 248/210; 280/47.19

[56] References Cited

U.S. PATENT DOCUMENTS

| | | | |
|---|---|---|---|
| 2,911,133 | 11/1959 | Ruggieri | 182/124 |
| 3,131,900 | 5/1964 | Anderson et al. | 248/210 |
| 3,246,867 | 4/1966 | Ewing | 248/210 |
| 3,809,351 | 5/1974 | Bravo et al. | 248/210 |
| 3,897,080 | 7/1975 | Isom | 280/47.19 |
| 3,987,993 | 10/1976 | Hopkins | 248/210 |
| 4,077,595 | 3/1978 | Carter et al. | 248/210 |
| 4,227,710 | 10/1980 | Laub | 280/47.19 |
| 4,318,454 | 3/1982 | Johnson | 248/210 |
| 4,613,042 | 9/1986 | Aeschliman | 206/419 |

FOREIGN PATENT DOCUMENTS

| | | | |
|---|---|---|---|
| 2935043 | 3/1981 | Fed. Rep. of Germany | 206/443 |
| 1438546 | 4/1966 | France | 280/47.19 |
| 2133977 | 8/1984 | United Kingdom | 280/47.19 |

*Primary Examiner*—Jimmy G. Foster

*Attorney, Agent, or Firm*—Richards, Harris, Medlock & Andrews

[57] ABSTRACT

A holder (10) is provided for holding fluorescent light bulbs (14). The holder (10) is used with a ladder (14) having a rail (24). The holder (10) includes a lower bracket (20) for receiving an end of the fluorescent light bulb (14) and an upper bracket (22) for receiving the upper portion of the fluorescent light bulb (14).

13 Claims, 3 Drawing Figures

FLUORESCENT LIGHT BULB HOLDER

TECHNICAL FIELD

The present invention relates to holding devices which are removably attached to ladders, and more particularly to a device for holding fluorescent light bulbs.

BACKGROUND OF THE INVENTION

In the servicing and cleaning of lights in buildings, it has been a common practice for a serviceman to carry a large carton or cartons containing fluorescent light bulbs. The fluorescent light bulbs are long, bulky and quite fragile and therefore, must be handled with great care. In addition, a suitable ladder must be carried to allow the serviceman to reach the elevated lights on the walls and ceilings of the building. In many instances, two servicemen are required; one to remove or replace the fluorescent light bulb from the fixture while standing on the ladder, and a second person to transfer light bulbs to the person standing on the ladder. If one serviceman is used, he must transport the fluorescent light bulb while going up and coming down the ladder. Although these methods have been successfully used, they have not proved entirely satisfactory under all conditions of service for the reasons that these methods are time consuming and constitute an inefficient use of labor.

A need has thus arisen for a fluorescent light bulb holder which can be utilized in combination with a ladder to allow a single person to service fluorescent light bulb fixtures easily and efficiently while the person is positioned on the ladder.

SUMMARY OF THE INVENTION

In accordance with the present invention, a holding device for holding fluorescent light bulbs is provided for use with a ladder. Structure is mounted to the rail of the ladder for receiving an end of the fluorescent light bulb. Structure is additionally mounted on the rail of the ladder being spaced apart from the first structure for receiving the fluorescent light bulb adjacent the opposite end thereof.

In accordance with another aspect of the present invention, a holder for fluorescent light bulbs having first and second ends is provided for use with a ladder having side rails. The holder includes a receptacle for receiving the first end of the fluorescent light bulb. The receptacle is mounted to the rail of the ladder. A clamp is provided for removably attaching the receptacle to the rail. A bracket is provided which is mounted to the rail of the ladder. The bracket is spaced apart from the receptacle and receives the fluorescent light bulb between the first and second ends thereof. The bracket is generally U-shaped having parallel legs, such that the fluorescent light bulb is received between the legs of the bracket. A clamp is provided for removably attaching the bracket to the rail of the ladder.

BRIEF DESCRIPTION OF THE DRAWINGS

For a more complete understanding of the present invention and further advantages thereof, reference is now made to the following Detailed Description taken in conjunction with the accompanying Drawings in which.

DETAILED DESCRIPTION

Figure 1:
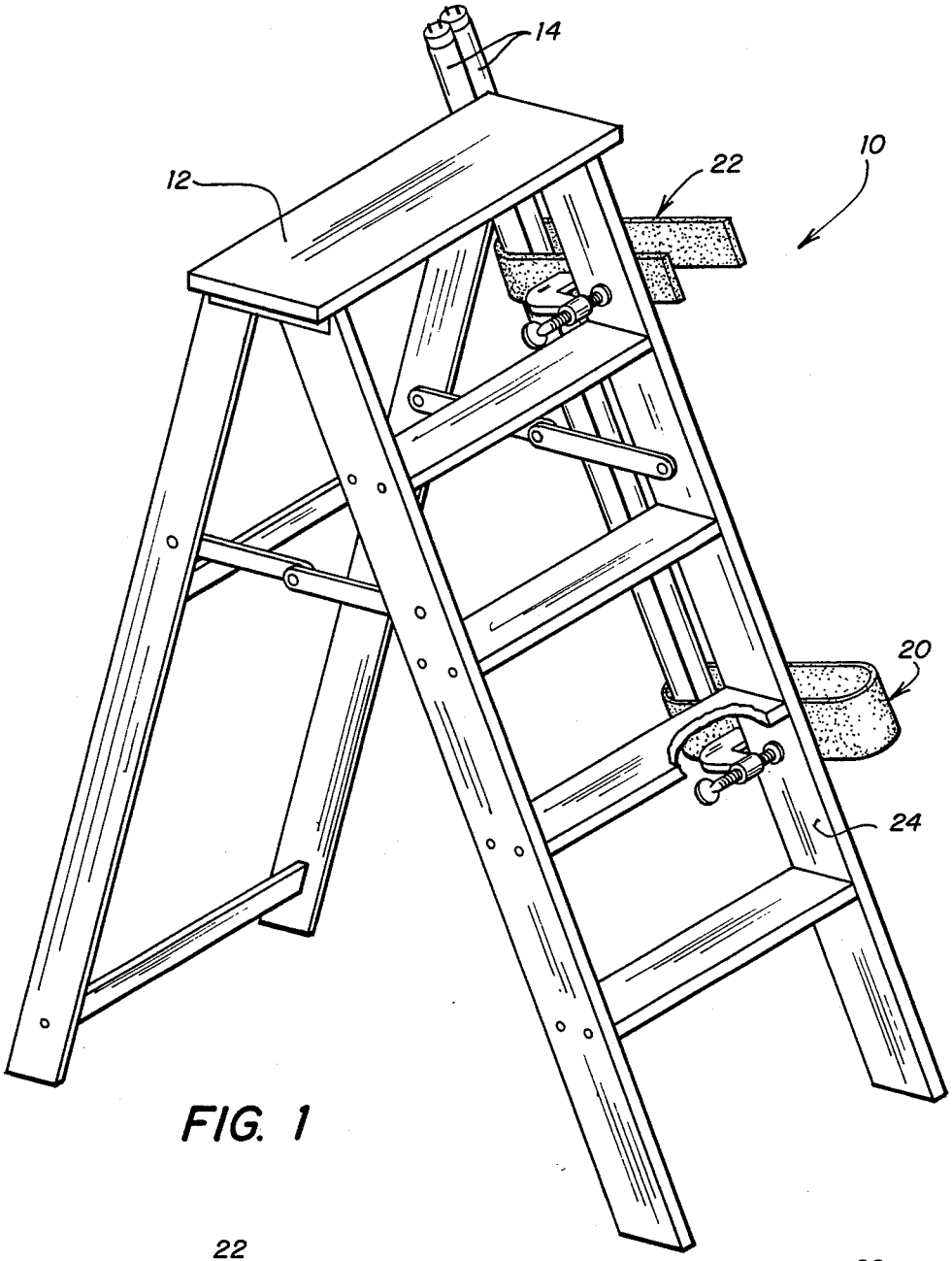
FIG. 1 is a perspective view of the present holding device mounted to the rail of a ladder including fluorescent light bulbs positioned therein.
Figure 2:
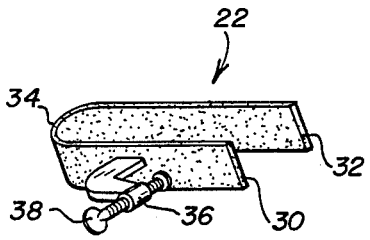
FIG. 2 is a perspective view of the upper bracket of the present invention.
Figure 3:
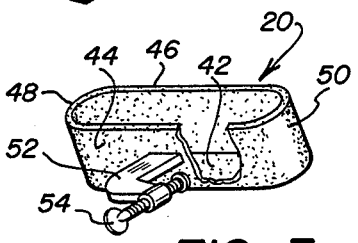
FIG. 3 is a perspective view of the lower bracket of the present invention.

Referring simultaneously to FIGS. 1, 2 and 3, the present holding device is illustrated, and is generally identified by the numeral 10. Holding device 10 is mounted to a conventional ladder 12 for holding fluorescent light bulbs 14. Holding device 10 includes a lower bracket 20 and an upper bracket 22 which is spaced apart from lower bracket 20. Brackets 20 and 22 are adjustably and removably attached to a rail 24 of ladder 12. Brackets 20 and 22 may be selectively placed along rail 24 of ladder 12 depending upon the length of fluorescent light bulbs 14 as well as the height of ladder 12.

Referring to FIGS. 1 and 2, upper bracket 22 is generally U-shaped having parallel legs 30 and 32 interconnected by a curvalinear section 34. Light bulbs 14 are positioned between legs 30 and 32 as illustrated in FIG. 1. The length of legs 30 and 32 are selected to accommodate several light bulbs 14 therebetween. Upper bracket 22 is mounted to rail 24 of ladder 12 using a clamp 36 having an adjustable screw 38. Clamp 36 may be attached to either leg 30 or 32.

Referring now to FIGS. 1 and 3, lower bracket 20 includes a base member 42, side walls 44 and 46, and end walls 48 and 50. Base 42 and walls 44, 46, 48 and 50 are integrally formed to form a receptacle which receives an end of a fluorescent light bulb 14 as shown in FIG. 1. The size of lower bracket 20 is selected to accommodate several fluorescent light bulbs 14 and is generally the same length as the length of legs 30 and 32 of upper bracket 22. Lower bracket 20 is attached to rail 24 of ladder 12 in a manner similar to upper bracket 22. Lower bracket 20 includes a clamp 52 having an adjustable screw 54 for mounting lower bracket 20 to rail 24.

Although lower bracket 20 has been shown as having a general rectangular configuration, this configuration is shown for illustrative purposes only, it being understood that other shapes, such as, for example, circular or square can be utilized for lower bracket 20. Additionally, upper bracket 22 and lower bracket 20 may be permanently affixed to ladder 12 using screws and bolts or other attachment devices than clamps 36 and 52 shown in FIGS. 2 and 3. Brackets 20 and 22 may also be coated with a resilient material such as, for example, a latex rubber or foam material to provide a cushion for fluorescent light bulbs 14 when positioned within holding device 10.

It therefore can be seen that the present invention provides for a holding device that can be easily attached to the rails of a ladder for holding fluorescent light bulbs. The present holding device is simple in operation and maintenance and further provides for a safe holder to prevent damage to fluorescent light bulbs.

Whereas, the present invention has been described with respect to specific embodiments thereof, it will be understood that various changes and modifications will be suggested to one skilled in the art and it is intended to encompass such changes and modifications as fall within the scope of the appended claims.

What is claimed is:

1. A removable holder for receiving a plurality of fluorescent light bulbs, each bulb having first and second ends, the holder is for use with a ladder having a side rail, comprising:

first means for detachably mounting to the side rail of the ladder for receiving one end of the fluorescent light bulbs; and second means for detachably mounting to the side rail of the ladder for receiving fluorescent light bulbs between the first and second ends thereof, said second means including a generally U-shaped member having parallel legs, such that a plurality of fluorescent light bulbs may be received between said parallel legs.

2. The holder of claim 1 wherein said first means includes:

a receptacle having a bottom wall, side walls and end walls for retaining the first end of the fluorescent light bulb.

3. The holder of claim 2 and further including:

means attached to one of said receptacle side walls for mounting said first means to the side rail of the ladder.

4. The holder of claim 3 wherein said mounting means includes adjustable clamp means for clamping the side rail of the ladder between said side wall and said clamping means.

5. The holder of claim 3 wherein said mounting means includes adjustable clamp means.

6. The holder of claim 1 and further including:

means attached to one of said parallel legs for mounting said second means to the side rail of the ladder.

7. The holder of claim 6 wherein said mounting means includes adjustable clamp means for clamping the side rail of the ladder between said parallel leg and said clamping means.

8. The holder of claim 6 wherein said mounting means includes adjustable clamp means.

9. A removable holder for receiving a plurality of fluorescent light bulbs, each bulb having first and second ends, for use with a ladder having a side rail comprising:

receptacle means for receiving the first ends of the fluorescent light bulbs and for being detachably mounted to the rail of the ladder;

first clamp means attached to said receptacle means for removably attaching said receptacle means to the rail of the ladder;

bracket means for being detachably mounted to the rail of the ladder for receiving the plurality of fluorescent light bulbs between the first and second ends thereof, said bracket means being generally U-shaped having parallel legs, such that the fluorescent light bulbs are received between said parallel legs of said bracket means; and second clamp means attached to said bracket means for removably attaching said bracket means to the rail of the ladder.

10. The holder of claim 9 wherein said mounting means includes adjustable clamp means for clamping the side rail of the ladder between said parallel leg and said clamping means.

11. The holder of claim 9 wherein said receptacle means includes:

a bottom wall, parallel side walls and parallel end walls and is generally rectangular in shape.

12. The holder of claim 9 wherein said first and second clamp means includes means for adjusting said clamp means to the size of the ladder rail.

13. The holder of claim 9 wherein said receptacle means and said bracket means include resilient means for cushioning the fluorescent light bulb.

* * * * *